United States Patent [19]

Scott

[11] 3,936,055

[45] Feb. 3, 1976

[54] GOLF PRACTICE DEVICE

[75] Inventor: Rocco A. Scott, Burbank, Calif.

[73] Assignee: Joseph B. Michaelson, North Hollywood, Calif.

[22] Filed: Dec. 11, 1974

[21] Appl. No.: 531,755

[52] U.S. Cl. ..... 273/176 H; 273/178 B; 273/195 B; 206/315

[51] Int. Cl.[2] ..... A63B 69/36; A63B 67/02

[58] Field of Search ..... 273/176, 195, 185, 178, 273/179; 206/315

[56] References Cited

UNITED STATES PATENTS

| | | | |
|---|---|---|---|
| 2,057,504 | 10/1936 | Schafer | 273/176 H |
| 3,558,139 | 1/1974 | Brandell | 273/176 FB |
| 3,643,959 | 2/1972 | Cornell et al. | 273/185 R |
| 3,727,917 | 4/1973 | MacLean | 273/176 H |
| 3,831,949 | 8/1974 | Henning | 273/176 H |

*Primary Examiner*—George J. Marlo
*Attorney, Agent, or Firm*—Louis J. Bachard

[57] ABSTRACT

A golf shot practice stage comprising a frame having side panels which define "green" and "fairway" playing surfaces. The panels are positionable at different angles to the horizontal, supported by one or more angle defining wedges, to enable practice with different ball lies; and the stage is foldable into compact form for storage, with the wedges enclosed within the folded-up stage.

9 Claims, 6 Drawing Figures

GOLF PRACTICE DEVICE

BACKGROUND OF THE INVENTION

This invention has to do with devices for off-course practice of golf shots. More particularly, the invention relates to a compact, portable and storable golf shot practice stage which unfolds for use in practice of "green" or "fairway" golf shots but which can be folded up into compact form and stored easily.

The pursuit of excellence and consistency is a never-ending challenge, and therein a source of delight, to the golfer, so much so that, however often a golfer plays the game, he requires, or desires additional practice time. It is also true that being an outdoor game the availability of courses is limited by darkness and inclement weather factors; and crowding is common at almost all links, further restricting real course play time.

There is accordingly a need for devices to facilitate the home or office play of "golf." These devices have, to my present knowledge, been limited to real ball putting simulators or whiffle ball "tees" and have been limited to one or perhaps two variations in elevation and pitch preventing the simulation of the many various real lies encountered in actual play.

SUMMARY OF THE INVENTION

It is, therefore, an objective of the present invention to provide a golf shot practice device which is widely variable in lies and provides opportunity for both fairway and green type shots. Moreover, the device is compact and can be folded into an easily handled and stored form when not in use.

More particularly, the invention provides a portable, storable golf shot practice stage comprising a generally rectangular frame, a first side panel having a grass simulative playing surface, and a second side panel having a grass simulative playing surface. The first panel is suitably attached to the frame in out-folding relation to upwardly expose its playing surface in the playing configuration of the stage. The stage further comprises panel support means supporting the first or second panel in angled relation to the normally horizontal plane of the frame.

The first, outfolding side panel typically comprises plural individually angularly disposable sections articulated along lines extending transversely to its locus of attachment to the frame, the support means that being further separately engageable with the panel sections to independently define their angular disposition. This first panel is typically representative of a "green" or putting surface and for this purpose will be provided with a playing surface simulative of "green" grass in fineness, texture and depth e.g. like bent grass, and the panel may further be apertured beneath the playing surface with "holes" for ball reception, which holes may be selectively covered, e.g. with the "grass" surface covering or alternatively fitted with a true cup for ball collection.

The second of the mentioned side panels is typically rotatably attached at one edge margin to the frame e.g. with a loop or like hinges, whereby the second side panel may be disposed angularly relative to the normally horizontal plane of the frame, above the frame to provide an "uphill" or "downhill" lie, supported there by the panel support means described below. The second panel generally is provided with a grass simulative playing surface which resembles fairway grass in texture and depth e.g. similar to bermuda grass.

In preferred embodiments there is provided a third side panel perimetrically fixed to the frame and opposite to the first and second side panels above-mentioned. These side panels together cooperate to define with the frame a box-like cavity circumscribed by the frame and enclosed by the first and second side pane on one side and by the third side panel on the other side.

The panel support means typically comprise plural, thin, elongated, wedge-shaped members sized and adapted to interfit and be frictionally retained in retaining slots which as will be seen may be provided on the underside of the first panel, or certain of the first panel sections, or within the box-like cavity for use with the second panel, e.g. secured to the third panel, for the purpose of thereby defining the angular relation of the panel sections to the frame horizontal plane.

In particular embodiments, the golf shot practice stage includes a triptych first panel, i.e., a panel divided into three sections the outer, or outboard, of which are foldable onto the center section. Typically the outboard sections will carry the panel support retaining slots to vary the angular relation of the sections separately and relative to the center section of the panel, which lies generally in the horizontal plane of the frame, each of the outboard and center sections having a common playing surface e.g. simulative of "green" grass and "holes" therein distributed to give shot variety.

Returning to the second panel, as noted it may be rotatably attached to the frame along one edge margin thereof; there may further be provided means defining a retaining slot within the frame cavity sized to retain the wedge-shaped panel support means in rotated second panel supporting relation, the second panel again having a playing surface simulative of "fairway" grass.

Preferably the first and second side panels are hinged to one side of the frame and on opposite edges thereof, the first side panel sections folding on themselves to the size of the frame, to overlie the first side panel upon complete folding together of the stage, the wedge-shaped panel support members, which may vary among themselves in their base dimension to define varying angles of panel disposition when retained in the retaining slots, being enclosed within the cavity defined by the folded in panels and frame.

It is an important feature of the device, providing storability and portability, that the frame cavity is sized to contain for storage the wedge shaped members otherwise used for panel support, in the stored configuration of the stage, there being further provided latch means to secure the first and second panels folded against the frame, and a handle on the frame for carrying of the stage.

BRIEF DESCRIPTION OF THE DRAWING

The invention will be further described as to an illustrative embodiment thereof with reference to the attached drawings, in which.

DESCRIPTION OF THE PREFERRED EMBODIMENT

Figure 1:
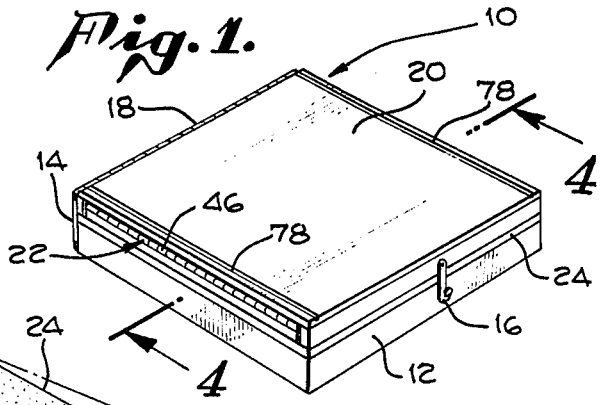
FIG. 1 is a perspective view of the golf shot practice stage according to the invention in closed condition for storage.

Referring now to the drawings in detail, in FIG. 1 the golf shot practice stage is shown at 10 folded up for storage or transport. The stage frame 12 is a square and comes hinged at the base extension 14 thereof opposite latch set 16 on panel lip 17, by piano hinge 18, a first side panel 20 having plural folded sections indicated at 22 and a second side panel 24 enclosed thereby, all of which parts are shown as well in FIGS. 2, 3, 4 and 5.

Figure 2:
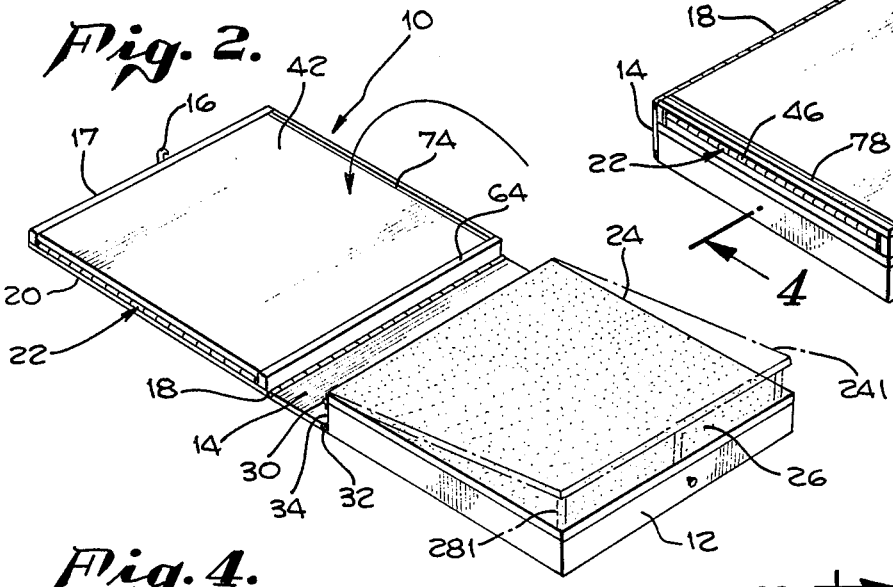
FIG. 2 is a like view thereof partly opened out for practice of fairway shots.

In FIG. 2 the golf practice stage of the invention is depicted as set up for practice of "fairway" shots, suitably using a whiffle ball, not shown, on the somewhat coarse textured fairway grass simulative covering 26 on second side panel 24, the first side panel 20 having been folded out from the frame 12 on frame base extension 14 and hinge 18.

The sloped or tipped disposition of the second panel is shown in phantom at 241 supported by wedge 281 as will be more fully described hereinafter, this cocked disposition relative to the normally horizontal plane of the frame 12 being for the purpose of simulating an uphill or downhill lie, and being realized by arcuate movement or rotation of the second panel 24 (241) about piano hinge 30.

Figure 5:
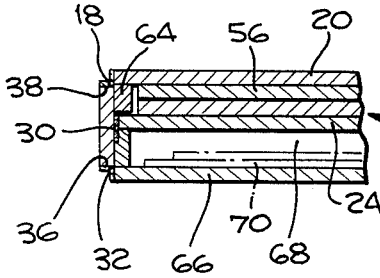
FIG. 5 is a fragmentary view in transverse section taken on line 5—5 in FIG. 4.
Figure 3:
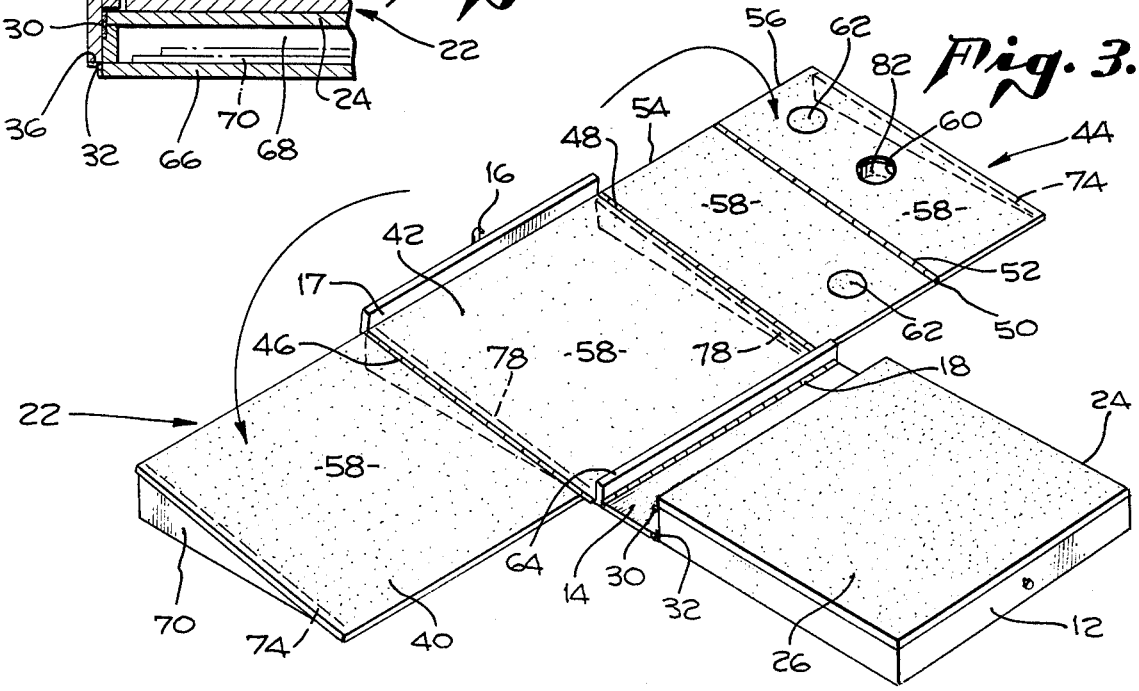
FIG. 3 is a like view thereof fully opened out for practice of green or putting shots.

With reference now particularly to FIGS. 2, 3 and 5 the operation of the "green" portion of the golf shot practice stage 10 will be described. As best shown in FIG. 2 the first panel 20 is hinged to base extension 14 by piano hinge 18. Base extension 14 in turn is hinged by another piano hinge 32 to the base 34 of frame 12. All hinges shown as piano hinges herein may be leather, plastic or wire loops or the like for lower cost.

The first panel 20 is folded out from the frame 12, the base extension 14 rotating about its inner edge 36 and the first panel rotating about the outer edge 38 thereof on the aforementioned hinges 32 and 18 respectively. See FIG. 5.

In FIG. 3 the first panel 20 is shown fully outfolded from the frame 12 and opened laterally as well to expose its playing surface having a covering of relatively fine, dense matting 58 simulative of "green" grass, typically bent grass. The first panel 20 is shown to comprise a left outboard section 40, a center section 42 and a right outboard section 44, all sections being hinged together by piano hinges 46, 48 and the section 44 being further medially hinged at 50 by piano hinge 52 into subsections 54, 56 which are useful to obtain a "break" in the path toward "hole" 60 containing cup 82, which is illustrative of a putting target. Other holes may be provided at various locations (see 62 in the drawing) covered over with the grass imitative surface covering. Upper and lower lips 17, 64 are provided on center section 42 against unwanted ball loss.

A third side panel 66 closes the frame 12 opposite the first and second side panels 20, 24 respectively and defines therewith a box-like cavity 68 which serves to store wedges 70 not to be described. As has been mentioned and as illustrated in the drawings, an important feature of the present golf shot practice stage is its ability to provide undulating or at least pitched lies.

Figure 6:
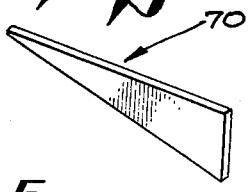
FIG. 6 is a perspective view of a wedge-shaped member used with the golf shot practice stage.

This is realized by providing plural wedges 70 on the one hand, being thin, elongated wedge-shaped members as shown in FIG. 6 and retaining slots for the wedges on the other e.g. slots 72 within the cavity 68 which serve to hold wedges 281 in place to support panel 241 in inclined relation to the frame; slots 74 in first panel sections 40, 44 and the slots 76 defined by the several piano hinge recesses 78. The slots 72, 74, and 78 as will be observed can be carried by the playing surface defining panel e.g. panel 20 or its sections 40, 42, and 44, as with slots 74 and 78 or by panel independent means such as rails 80 within cavity 68 as in the case of slots 72.

Figure 4:
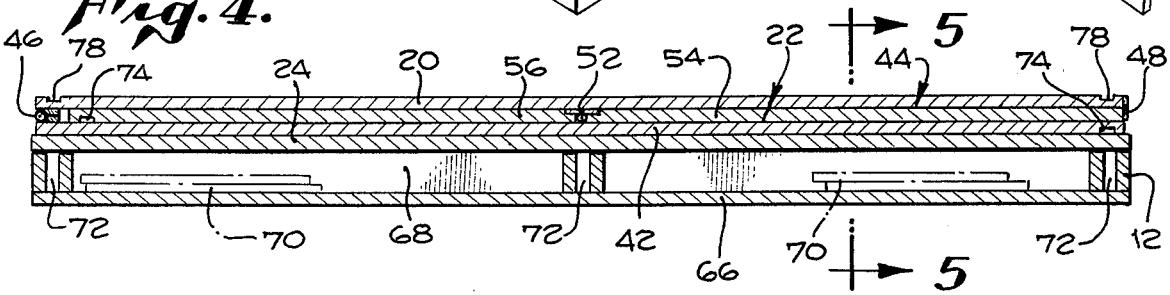
FIG. 4 is a view in section taken on line 4—4 in FIG. 1.

When use of the stage is completed, the several panels fold together in the reverse of the opening procedure, after first having placed the wedges 70 within the cavity, along with the practice cup 82, into the storage configuration best shown in FIGS. 1 and 4.

I claim:

1. A portable, storable golf shot practice stage comprising a generally rectangular frame, a first side panel having a grass simulative playing surface, a second side panel having a grass simulative playing surface, a third side panel perimetrically fixed to one side of said frame and opposite said first and second panels, said first panel being attached to said frame in out-folding relation to upwardly expose its playing surface in the playing configuration of the stage; said second and third side panels cooperating to define with the frame a box-like cavity circumscribed by the frame, and enclosed by said second and third panels, and panel support means comprising plural thin, elongated, wedge-shaped members; said first side panel carrying retaining slots sized to frictionally retain said support members to thereby define the angular relation of said first panel to the frame horizontal plane.

2. Golf shot practice stage according to claim 1, in which said first side panel comprises plural individually angularly disposable sections articulated along lines extending transversely to its locus of attachment to the frame, and said support means is separately engageable with said panel sections to independently define their angular dispositions.

3. Golf shot practice stage according to claim 2 in which said first panel playing surface is fine textured to be simulative of "green" grass, and said panel is locally apertured to define a series of holes.

4. Golf shot practice stage according to claim 1, in which said second side panel is rotatably attached at one edge margin to said frame.

5. Golf shot practice stage according to claim 4, in which said second panel playing surface is coarse textured to be simulative of "fairway" grass.

6. Golf shot practice stage according to claim 1 in which said first panel is triptych, the outboard sections thereof carrying said retaining slots to vary the angular relation of said sections separately and relative to the center section of said panel, said center section lying generally in the horizontal plane of said frame, and said outboard and center sections having a common playing surface fine textured to be simulative of "green" grass.

7. Golf shot practice stage according to claim 6 in which said second panel is rotatably attached to said frame along one edge margin thereof, and including also means defining a retaining slot within said frame cavity sized to retain said wedge-shaped members in rotated second panel supporting relation, said second panel having a playing surface coarse textured to be simulative of "fairway" grass.

8. Golf shot practice stage according to claim 7 in which said first and second side panels are hinged to one side of said frame and on opposite edges thereof, said first side panel sections fold on themselves to the size of said frame, and said folded first side panel sections overlie said second panel; and said wedge-shaped members vary in their base dimension to define varying angles of panel disposition when retained in said retaining slots.

9. Golf shot practice stage according to claim 8 in which said frame cavity is sized to contain said wedge-shaped members in the stored configuration of the stage, and including also latch means to secure said first and second panel against the frame, and a handle on said frame.

* * * * *